United States Patent [19]

Schmid et al.

[11] 4,068,094

[45] Jan. 10, 1978

[54] METHOD AND APPARATUS FOR THE SCRAMBLED TRANSMISSION OF SPOKEN INFORMATION VIA A TELEPHONY CHANNEL

[75] Inventors: Pierre Schmid, Oberweningen; Eduard Brunner, Oberengstringen; Walter Stofer, Buchs, all of Switzerland

[73] Assignee: Gretag Aktiengesellschaft, Basel, Switzerland

[21] Appl. No.: 660,925

[22] Filed: Feb. 24, 1976

Related U.S. Application Data

[63] Continuation of Ser. No. 441,865, Feb. 12, 1974, abandoned.

[30] Foreign Application Priority Data

Feb. 13, 1973 Switzerland ..... 2026/73

[51] Int. Cl.[2] ..... H04K 1/00; H04K 1/04

[52] U.S. Cl. ..... 179/1.5 R; 179/1.5 S

[58] Field of Search ..... 179/1.5 R, 1.5 M, 1.5 S

[56] References Cited

U.S. PATENT DOCUMENTS

| | | | |
|---|---|---|---|
| 1,819,614 | 8/1931 | Mathes | 179/1.5 R |
| 1,921,063 | 8/1933 | Affel | 179/1.5 M |
| 2,411,206 | 11/1946 | Guanella | 179/1.5 R |
| 3,012,098 | 12/1961 | Riesz | 179/1.5 R |
| 3,133,991 | 5/1964 | Guanella | 179/1.5 R |
| 3,201,517 | 8/1965 | Gannett | 179/1.5 R |
| 3,688,193 | 8/1972 | McDonald | 178/22 |

*Primary Examiner*—Howard A. Birmiel
*Attorney, Agent, or Firm*—Burns, Doane, Swecker & Mathis

[57] ABSTRACT

A method of scrambling and unscrambling speech transmissions by first dividing the speech frequencies into two frequency bands and reversing their order by modulating the speech information, the width of the bands being varied by varying the carrier frequency used in the modulation process, adding to the reversed frequency bands at least one supplementary signal derived from the modulation process and transmitting the resultant signal. The transmitted signal is unscrambled by first subtracting from it a supplementary signal which is generated at the receiving station from the received scrambled signal, the last mentioned supplementary signal being identical to that added to the reversed frequency band signal prior to transmission and then subjecting the resultant signal to the same modulation processes as referred to above to reassemble the frequency bands into a frequency band containing substantially the same speech frequencies as those that are scrambled. Apparatus for carrying out the above method can comprise a separate transmitter and receiver or a single transmitter/receiver whose mode of operation is controlled by a speech key, the transmitter and receiver each including a frequency scrambling device employing modulators and a time scrambling device for generating the supplementary signal.

32 Claims, 20 Drawing Figures a
1 2 3 4 5 6 8 10 15 kHz
24
b
f4
196 198 200 202 204 206 208 kHz
c
f5
f6
194 196 198 200 202 394 396 398 kHz
26
d
f4
194 196 198 200 202 204 206 208 kHz
e
1 2 3 4 5 6 8 10 15 kHz
f
f4
194 196 198 200 202 204 206 208 kHz
24
g
f5
f6
194 196 198 200 202 394 396 398 kHz
26
h
f4
194 196 198 200 202 204 206 208 kHz
i
1 2 3 4 5 6 8 10 15 kHz

METHOD AND APPARATUS FOR THE SCRAMBLED TRANSMISSION OF SPOKEN INFORMATION VIA A TELEPHONY CHANNEL

This is a continuation, of application Ser. No. 441,865 filed Feb. 12, 1974 now abandoned.

FIELD OF THE INVENTION

The invention relates to a method for the scrambled transmission of speech information via a telephony channel by means of a control signal which is generated in the transmission system and in the reception system.

PRIOR ART

The prior art discloses a method for scrambling messages in which speech transmission is kept secret by the addition of interference signals to the speech signals prior to the transmission thereof and by the subtraction after transmission of the same interference signals from the received signal. The interference signal is obtained from a low-frequency oscillator and is transmitted together with the speech signals. Elimination of the interference signal at the receiver is possible only to a limited extent due to unavoidable frequency-related phase and amplitude distortions of the transmission line and this method has not therefore been accepted in practice.

It has also been proposed to apply predetermined amounts of frequency shift prior to transmission to parts of the message signals which are to be scrambled and to apply to the received signals the same amounts of frequency shift in the reverse direction. Frequency shift is obtained by one control signal at the transmitter and one at the receiver. This method ensures adequate secrecy only if the control signals are variable. Controlled signals which can be varied in accordance with an agreed program are therefore utilised for scrambling and unscrambling. These control signals are generated by the transmitter as well as by the receiver by means which operate in synchronism so that the control signal at the transmitter and at the receiver are identical at each moment to enable an intelligible message to be obtained from the receiver. Synchronism between the two control signals can be maintained by known means, special synchronising signals being transmitted with the scrambled messages for the purpose of constantly monitoring the synchronisation. This solution to the problem is very complex. It has therefore also been proposed to produce a variable signal in accordance with an adjustable code to control the frequency shift of the message at the transmitter by means of a control signal derived from the variable signal and to control the reverse shift in the receiver with the derived control signal.

The prior art also discloses systems in which relatively narrow-band filters divide the speech into a plurality, for example eight, frequency bands which are then intermixed and transmitted. The frequencies in the individual bands are then filtered by the receiver and are serially aligned in the original sequence. Systems of this kind have an exceptionally large code repertoire. A disadvantage of such a system is that $n$ frequency bands call for at least $2n$ modulators and $n$ narrow frequency band filters. Since the rise and fall of the characteristic of the narrow band filters are finite it is impossible to avoid an additional loss of band width and since the band pass filters are narrow for the individual frequency bands the presence of transients mitigates against rapid code switching as this would otherwise give rise to excessive interference noise.

It is also known to sub-divide the frequencies of the messages to be scrambled into at least two bands which are interchanged, the width of the bands being varied by the control signals. All these known methods suffer from the disadvantage that the speech rhythm is easily detectable in the scrambled signal and that a skilled third party with some experience is able to recognise at least partially the scrambled message.

It is the object of the invention to provide a method and apparatus by means of which the speech rhythm, i.e. the syllable and the word rhythm is scrambled in addition to scrambling the sound character, i.e. the form structure of the speech signal.

SUMMARY OF THE INVENTION

The method according to the invention is characterised by the speech band being sub-divided at the transmitting station by a plurality of modulation processes into at least two complementary frequency bands which are interchanged, the radio of the width of the partial bands being controlled by a control signal which is generated at the transmitting station. The modulation produce which represents the interchanged frequency bands within the band width of the telephony channel have added to it at least one supplementary time shifted signal which depends on the modulation product for forming a scrambled signal which is transmitted via the telephony channel. The supplementary signal is derived at the receiving station from the received scrambled signal and is subtracted therefrom, the modulation product being restored by subjecting it to the same modulation processes in the receiving station as those to which the speech band was subjected to the transmitting station.

Apparatus according to the invention for performing the above method is provided at the transmitting station and at the receiving station with a coding generator adapted for control by a base generator for generating the controlled signal, means are provided at the transmitting station to generate from the speech band two interchanged complementary frequency bands which are disposed within the band width of the telephony channel and a device for adding at least one positive or negative echo to the modulation product which appears at the output of the modulating device. The receiving station includes a device for regenerating the echo from the received scrambled signal and for subtracting the same and a demodulating device for converting the restored modulation product into a signal which is at least similar to the speech signal and that both the modulating device and the demodulating device are provided with one input for supplying a carrier frequency which depends on the control signal.

DETAILED DESCRIPTION OF THE EMBODIMENTS

Figure 1:
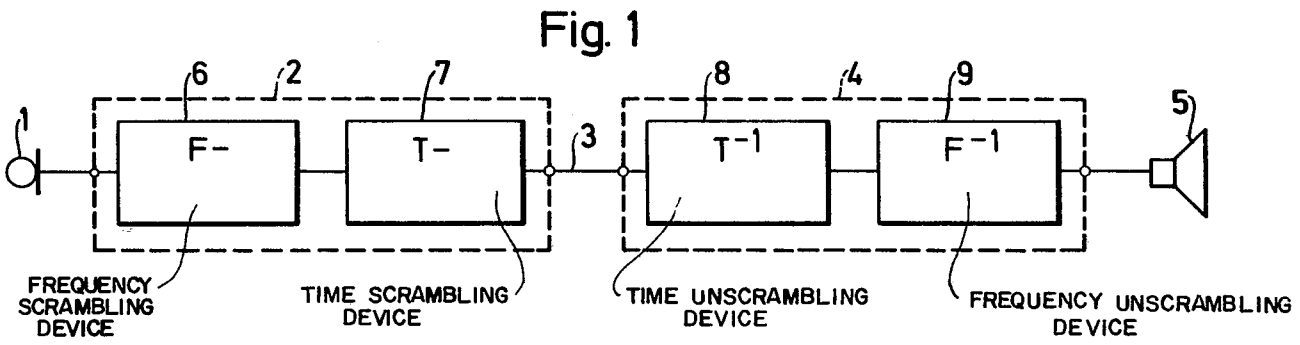
FIG. 1 shows in block form a simple system for the scrambled transmission of spoken informative via a transmission channel.

FIG. 1 shows the basic diagram of a simple system for the scrambled transmission of speech information which is converted into electrical signals by a microphone 1 and transmitted by a transmission by a transmission station 2 via a transmission channel 3 to a reception station 4 to which acoustic transducer 5, such as earphones or loudspeaker, is connected.

The transmission station 2 is provided with a frequency scrambling device F, hereinafter referred to as device 6, for dividing the speech band into at least two frequency bands and cyclically interchanging and inverting them. The transmission station 2 also contains a time scrambling device T, referred to as device 7, for adding a time-dependent signal to the output signal of the device 6. A scrambling transmission signal appears at the output of the device 7 and is supplied via the transmission channel 3 to the reception station 4.

The reception station 4 is provided with a time unscrambling device 8 for subtracting from the received scramble signal a signal which is at least similar to the time dependent signal that is added in the transmission station to the transmission signal and a frequency unscrambling device, $F^{1}$ referred 9, for reversing the cyclical interchanging and inverting of the frequency bands performed by the device 6 in the transmission station 2 so that a signal which is at least similar to the speech signal produced by the microphone 1 appears at the output of the device 9 and is applied to the acoustic transducer 5.

The transmission channel 5 may be any telephony channel with a band width of, for example, 300–3400 Hz in accordance with the CCITT recommendations, This telephony channel may comprise a wire line, a carrier telephony channel, a radio link channel or a mixed link channel. The frequency spectrum of the scrambled transmission signal which contains practically the entire information should not therefore contain any frequency outside the band width of the transmission signal.

A first embodiment of the device 6 is explained hereinbelow with reference to FIGS. 2 and 3. The speech signals which are generated by the microphone 1 pass to an input filter 10 which limits the frequency spectrum of the speech signal to a speech band of, for example, 300 to 3000 Hz. The pass range of this input filter 10 is indicated at *a* in FIG. 3 by the line 11. The frequency-limited speech band 12, which is supplied to an interconnecting element 13 and to a first modulator 14, is shown below the aforementioned section *a*. The modulator 14 is also supplied with a carrier frequency $f_1$. The modulator 14 preferably comprises a so-called ring modulator the output of which supplied only the modulation products while the carrier frequency itself is substantially attenuated. The two side bands which appear at the output of the modulator 14 are shown in section *b* of FIG. 3.

Figure 3:
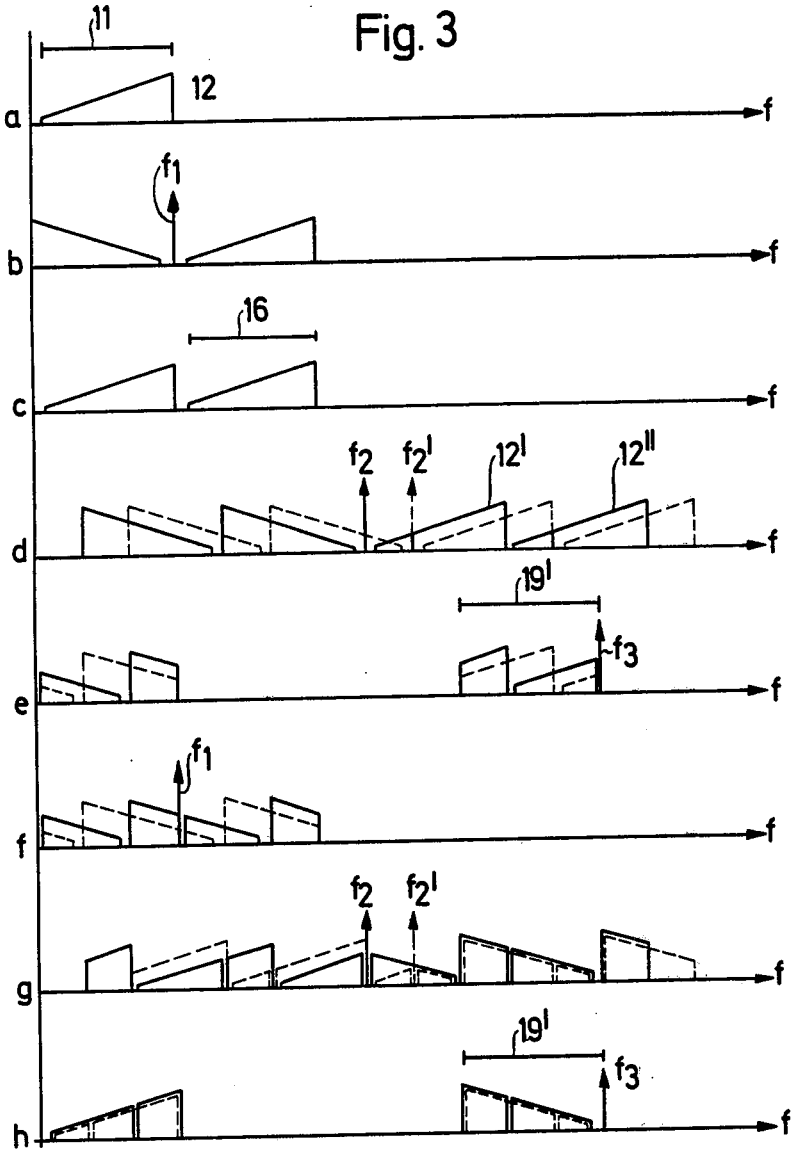
FIG. 3 is a graph of the signals occuring in the device of FIG. 2 and the system shown in FIG. 1.

These two side bands are supplied to a band pass filter 15 the pass range of which is indicated by the line of 16 of section *c* in FIG. 3. The upper side band which appears at the output of the band-pass filter 15 is also supplied to the interconnecting element 13 so that the original speech band 12 and a speech band which is shifted by the amount of carrier frequency $f_1$ appears at the output of the aforementioned interconnecting element as indicated in section *c* of FIG. 3.

The summation signal which appears at the output of the interconnecting element 13 passes to a second modulator 17 which is supplied with a variable carrier frequency $f_2$ generated by a controllable oscillator 18. The lower and upper side bands which appear at the output of the second modualator 17 and are shown in section *d* of FIG. 3 are supplied to a band-pass filter 19 the pass range of which is indicated by the line 19′ in section *e* of FIG. 3. This band-pass filter 19 admits part of the upper side band which contains two adjacent frequency-disposed speech bands 12′ and 12″. The limits of the pass range provided by the band pass filter 19 are arranged so that part of the frequency band 12° and part of the frequency band 12″ which is complementary to the first mentioned frequency band, both appear at the output of the band pass filter 19. These frequency bands are illustrated in section *e* of FIG. 3 below the line 19′.

These complementary bands are supplied to a third modulator 20 which is fed by a carrier frequency $f_3$. The modulation products which appear at the output of the third modulator pass to an output filter 21 which substantially comprises a low-pass filter with a limiting frequency of, for example, 3000 Hz. The complementary frequency bands appear in the inverted position at the output of the output filter 21 as illustrated at the beginning of section *e* of FIG. 3.

The carrier frequency $f_2$ which is supplied to the second modulator 17 is variable as already mentioned, namely in dependence on a control signal *s* which is supplied to the oscillator 18. If the carrier frequency thus supplied is $f_2'$ the side bands shown in broken lines in section *d* of FIG. 3 will then appear at the output of the modulator 17. The band pass filter 19 therefore passes the complementary frequency bands which are shown in broken lines in section *e* of FIG. 3. The range of variation of the carrier frequency $f_2$ is preferably selected so that the limit between the complementary frequency bands fluctuates in discrete steps in the range between the lower and upper frequency limit of the band pass filter 19.

The complementary frequency bands which appear in the inverted position at the output of the output filter 21 are supplied to the device 7 which is described below. A signal which is as closely similar as possible to the aforementioned signal is passed in the receiving station 4 to the input of the device 9 which can be of identical construction to the device 6 described with reference to FIGS. 2 and 3. The complementary frequency bands (see FIG. 3 beginning of section *e*) instead of the speech signals that are generated by the microphone 1 will then pass to the input of the input filter 10. The complementary frequency bands and the complementary frequency bands which are shifted by means of the first modulator 14 and by the band pass filter 15 are then serially aligned in the interconnecting element 13 as illustrated in section *f* of FIG. 3.

The summation signal which appears at the output of the interconnecting element 13 is supplied to the second modulator 17 whose modulation products are illustrated in line *g* of FIG. 3. The band pass filter 19, whose pass range is illustrated by the line 19' in section *h* of FIG. 3 passes the inverted speech band but not the upper side band. The interchanged complementary frequency bands are again aligned in the correct sequence by virtue of the modulation process in the second modulator 17, by the particular selection of the pass range of the band pass filter 19 and by utilising the same carrier frequency $f_2$ for the modulator 17 as is used in the transmission station. The restored speech band will however be in the inverted state and will be supplied to the third modulator 20 which reverses the speech bands into the original normal position that is illustrated at the beginning of section *h* of FIG. 3. The upper side band produced by this modulation process is suppressed by the output filter 21. Accordingly, a signal which is at least similar to the speech signal that is produced by the microphone 1 will appear at the output of the output filter 21.

In general terms the carrier frequency $f_1$ which is supplied to the modulator 14 corresponds to the highest speech frequency that is to be transmitted to prevent an excessive gap between the speech bands which appear at the output of the interconnecting element 13. The carrier frequencies $f_2$ and $f_3$ are chosen for the kind of band pass filter 19 that is employed. For example, if a mechanical filter is used it will be advantageous to select a frequency of approximately 200 kHz for the carrier frequencies $f_2$ and $f_3$ because the optimum band-pass of such mechanical filters is in this range.

Figure 4:
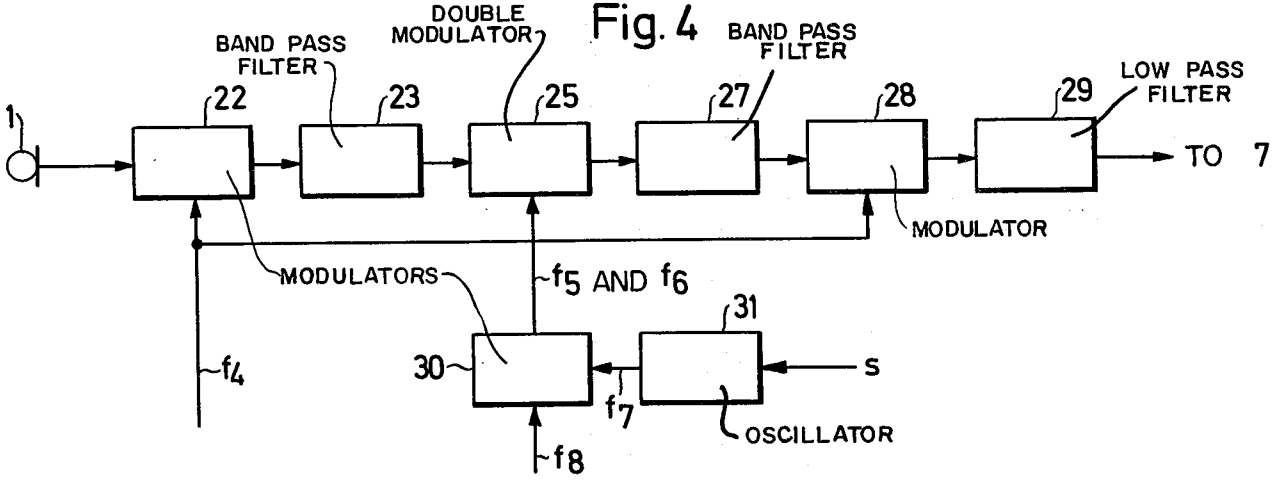
FIG. 4 shows a block diagram of a further embodiment of a device for cyclically shifting and converting the frequency bands derived from the speech signals.
Figure 5:
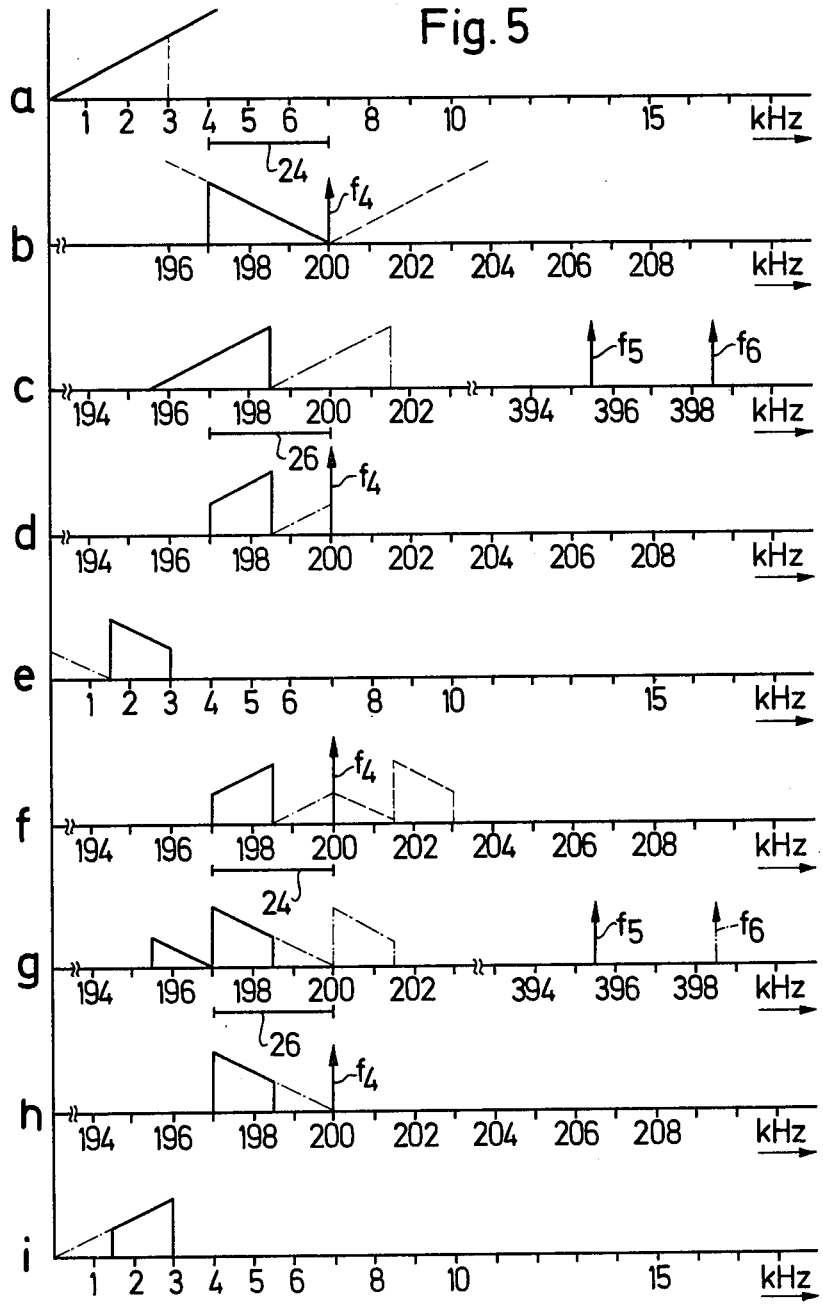
FIG. 5 is a graph illustrating the method of operation of the device according to FIG. 4.

FIG. 4 shows a further embodiment of the device 6 of the system illustrated in FIG. 1 and is described hereinbelow. The speech signals which are produced by the microphone 1 are supplied directly to a first modulator 22 which is driven at a relatively high carrier frequency $f_4$, for example 200 kHz. The lower side band of the two side bands, see section *b* of FIG. 5, which appear at the output of the first modulator 22, is selected by means of a band pass filter 25 whose band-pass of approximately 3kHz is indicated by the line 24 above the section *b* and is supplied to a double modulator 25 which functions as multiplier. The double modulator 25 is supplied simultaneously with two carrier frequencies $f_5$ and $f_6$ which differ from each other by the difference between the limiting frequencies of the band pass filter 25 and can be shifted by approximately ± 1.5 kHz, referred to a mean value, the frequency difference of these carrier frequencies $f_5$ and $f_6$ always remaining constant. Two side bands therefore appear at the output of the double modulator 25 but only the lower side band is shown in section *c* of FIG. 5. The upper side band is not shown in this section because it is disposed far outside the illustrated frequency range. Each of these side bands comprises two serially disposed but frequency-offset speech bands in the normal position because the double modulator 25 is driven by the two carrier frequencies $f_5$ and $f_6$. The two carrier frequencies $f_5$ and $f_6$ are in their middle position in the example that is illustrated in FIG. 5. These carrierfrequencies are selected so that the middle of the lower side band coincides with the middle of the band-pass range, see line 26 of section *d* of FIG. 5, of a band pass filter 27. The band pass filter 27 filters complementary frequency bands from the lower side band as illustrated in section *d* of FIG. 5.

Depending on the excursion of the carrier frequencies $f_5$ and $f_6$ from their middle positions the proportion of one complementary frequency band will be greater or smaller than the other. The complementary frequency bands are supplied to a third modulator 28 which is preferably driven at the same carrier frequency $f_4$ as that used for driving the first modulator 22. Only the lower side band, which is illustrated in section *e* of FIG. 5, is passed by a low-pass filter 29 which appears at the output of the second modulator 28. The two cyclically displaced complementary frequency bands are in the inverted position and then pass to the device 7 of the transmitting station 2.

The two carrier frequencies $f_5$ and $f_6$ for the double modulator 25 are generated in a fourth modulator 30 which is supplied with a variable frequency $f_7$ produced by a controllable oscillator 31 and with a constant frequency $f_8$, for example of 1.5 kHz. The frequency $f_7$ generated by the oscillator 31 is varied by the control signal *s* which is supplied to the oscillator and may swing over the range of approximately ± 1.5 kHz, about a mean value of 397 kHz. For example, if the fourth modulator 30 is supplied with a frequency $f_7$ of 397 kHz and the constant frequency $f_8$ of 1.5 kHz is supplied the two frequencies $f_5 = f_7 - f_8 = 395.5$ kHz and $f_6 = f_7 + f_8 = 398.5$ kHz will appear at the output of the aforementioned modulator. These two carrier frequencies are supplied to the double modulator 25 to form the lower side band which is illustrated in section *c* of FIG. 5.

Figure 2:
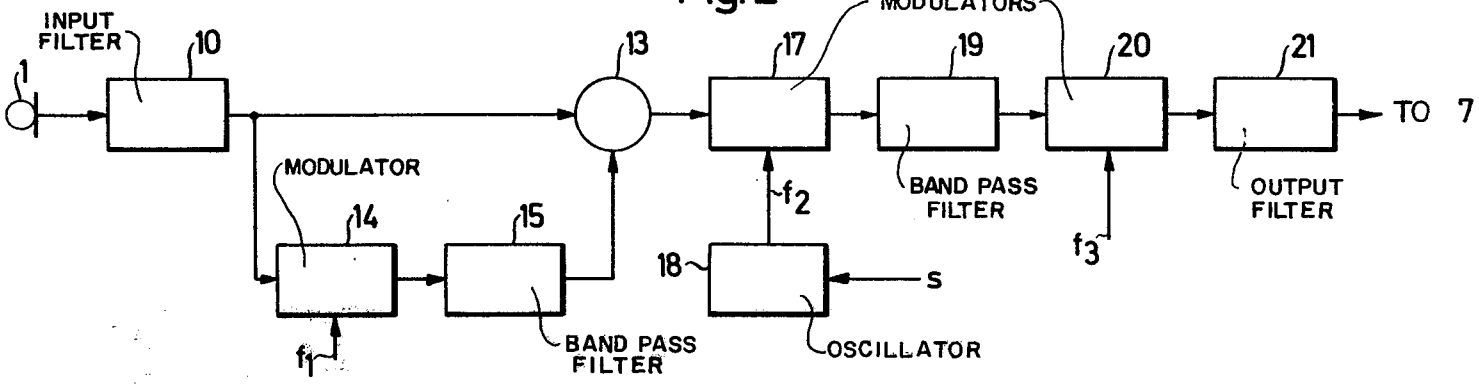
FIG. 2 shows a block diagram of a device included in the system of FIG. 1 for cyclically shifting and inverting the frequency bands derived from the speech signals.

The last mentioned device when compared with the first mentioned device shown in FIG. 2 offers the advantage of dispensing with the input filter 10 and the interconnecting element 13, also the band pass filters 23 and 27 are identical thus simplifying manufacture. Mechanical filters may be employed for the aforementioned band pass filters 23 and 27.

The complementary frequency bands shown in section *e* of FIG. 5 are then supplied to the input of the device 7 which is described below and is associated with a transmitting station 2 and appear finally in a manner to be described hereinbelow at the output of the device 8 of the reception station 4 to arrive at the input of the device 9 which is identical to the device 6 of the transmitting station 2. The interchanged complementary frequency bands are modulated in the first modulator 22. The modulation product is illustrated in section *f* of FIG. 5. The lower side band is filtered out by the band pass filter 25, whose band pass is indicated by the line 24, and is supplied to the double modulator 25. Section *g* of FIG. 5 shows the lower side band which appears at the output of the double modulator 25. Modulation with the carrier frequency $f_5$ yields the solidly drawn part of the lower side band and modulation with the carrier frequency $f_6$ yields the part of the lower side band which is shown in dash-dot lines. The adjacent portions of the aforementioned side bands again provide a complete, frequency-shifted speech band in the inverted position, this speech band being passed by the band pass filter 27 and supplied to the third modulator 28. The aforementioned speech band is restored to the original position in the last mentioned modulator, see section *i* of FIG. 5 and then passes via the low-pass filter 29 to the acoustic transducer 5.

The signals which appear at the output of the low-pass filter 29 or of the output filter 21 in the above described devices occur at the rhythm of the speech which is spoken into the microphone 1. This recognisable speech rhythm may provide an unauthorised third party with valuable hints for unscrambling the message. In order to avoid this defect time-dependent supplementary signals are added to the aforementioned signals in the device 7 which is described below. These supplementary signals are obtained from the signals which appear at the output of the device 6.

The basic method of operation of a first kind of time scrambling device by means of a positive echo, hereinafter referred to as echo, will be described below. Basic circuits for producing and adding a single and a decaying multiple echo to the input signal and restoring from and subtracting from the signal transmitted via the transmission channel 3 are described by reference to FIGS. 6 to 9.

Figure 6:
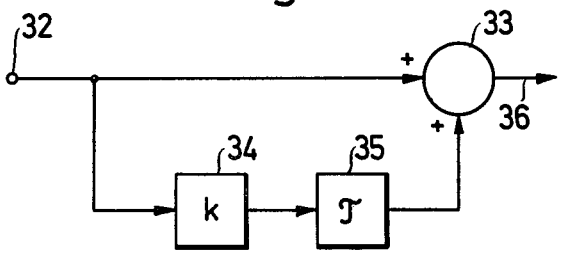
FIG. 6 shows a block circuit diagram of a device for producing a single echo of an input signal and adding it thereto.
Figure 7:
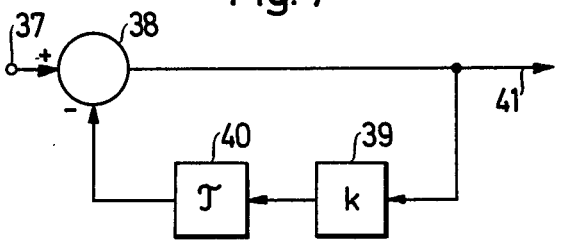
FIG. 7 shows a block circuit diagram of a device for regenerating and subtracting a single echo.

FIG. 6 is a basic circuit for adding a single echo to the signal which is applied to the input terminal 32, the signal being produced by the device 6. The signal passes to a summing element 33 and via an attenuation element 34, adapted to attenuate the signal by a factor $k$ to a delay element 35 which delays the attenuated signal by an amount $\tau$. The attenuated, delayed signal is also subsequently supplied to the summing element 33. A summed signal which contains the input signal and the attenuated delayed signal and is transmitted via the transmission channel 3 from the transmitting station 2 to the reception station 4 appears at the output 36 of the aforementioned summing element 33. The device 9 of the reception station 4 in this case substantially comprises a circuit according to FIG. 7. The summed signal is supplied to the input terminal 37 and passes to a subtracting element 38. The difference signal which appears at the output of the subtracting element is fed back to the device 9 and via an attenuation element 39 and a delay element 40 to the subtracting element 38. The factor $k$ by which the signals that are supplied to the attenuation elements 34 and 39 are attenuated is identical for both attenuation elements and may for example amount to 0.75. The delay time $\tau$ by which the delay elements 35 and 40 delay the signals supplied to them is also identical and may amount to, for example, 175 ms. A signal which practically corresponds to the signal that was supplied to the input terminal 32 of the circuit according to FIG. 6 will therefore appear at the output 41 of the circuit according to FIG. 7.

Figure 8:
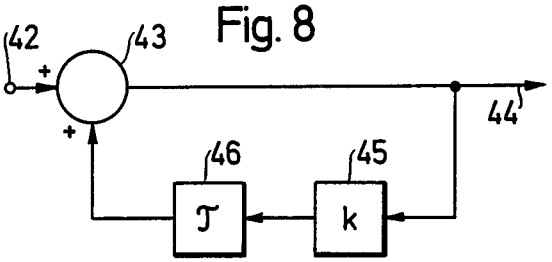
FIG. 8 shows a block circuit diagram of a device for producing a multiple echo of an input signal and adding it thereto.
Figure 9:
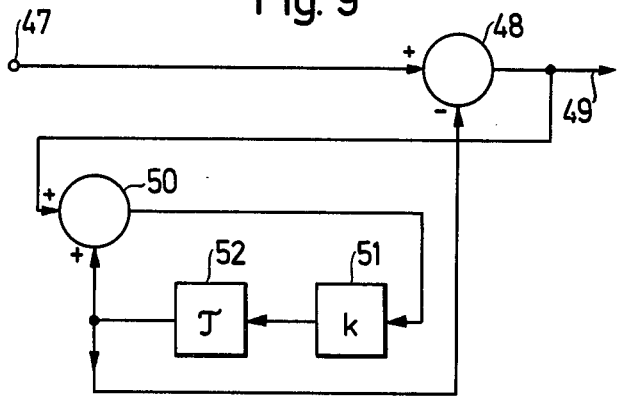
FIG. 9 shows a block circuit diagram of a device for regenerating and subtracting a multiple echo.

A multiple echo can be added to the input signal by means of the circuit which is shown in its basic form in FIG. 8. The input signal passes directly from the output terminal 42 into a summing element 43. From the summing element the summed signal passes directly to the output 44 and is transferred to the transmission channel 3. The summated signal is also fed back via an attenuation element 45 and a delay element 46 to the summing element 43. A multiple echo thus appears at the output 44, the nth echo being attenuated by the factor $k^n$ with respect to the original signal. The corresponding device 8 of the reception station 4 contains a circuit which is illustrated in FIG. 9. The summed signal which is received via the transmission channel 3 is transferred via an input terminal 47 to a subtracting element 48. The difference signal produced thereby is transferred to the output 49 and to a summing element 50. An attenuation element 51 in series with a delay element 52 is connected to the output of the aforementioned summing element 50 and the output of the delay element 52 is connected to the summing element 50 and to the subtracting element 48. The multiple echo is regenerated by means of the summing element 50, the attenuation element 51 and the delay element 52 and is subtracted in the subtracting element 48 from the signal which passes to the input terminal 47. A signal which corresponds practically to the signal supplied to the input terminal 42 of the circuit according to FIG. 8 appears on the output 49 of the circuit according to FIG. 9 and is transferred to the device 9 of the reception station 4. It will be evident that in the above described embodiment identical values must be selected for the factor $k$ of the attenuation elements 45 and 51 and for the delay time $\tau$ by which the delay elements 46 and 52 delay the signals that are supplied to them. The factor $k$ may be 0.9 and the delay time $\tau$ may for example amount to 175 ms.

Substantial word intervals, i.e. up to approximately 1 s, are filled with these echo parameters so that the speech rhythm of the signal that is transmitted via the transmission channel 3 is so obliterated as to be no longer recognisable. Complete restoration at the output 41 or 49 of the circuits according to FIG. 7 or 9 of the signal which is supplied to the input terminals 32 or 37 of the circuits according to FIGS. 6 or 8 respectively is possible only if the echo which is regenerated in the reception station 4 is precisely in phase with the received echo. Accordingly, the echo is added in the transmitting station 2 not to the speech signal which is produced by the microphone 1 but is first obtained from the signal that is produced by the device 6 and is then added thereto. In the reception station 4 the echo is first regenerated and subtracted from the received signal. As a result of this process the signal which corresponds to the complementary frequency bands in the inverted position thereof is restored and is supplied to the device 9 of the reception station 4. The phase relationship between the signal which is produced in the device 6 and the echo which is added in the device 7 is therefore influenced only by possible time-variable delay distortions of the transmission channel 3. Tests have however shown that any delay distortions and phase shifts of the transmission channel which may occur under practical conditions do not substantially influence the quality of echo compensation. If the order of the device 6 and of the device 7 where to be interchanged in the transmitting station 2 and the order of the device 8 and device 9 were to be interchanged in the reception station 4, this being theoretically feasible, the relative phase between the generated echos and the regenerated echos would be disturbed more particularly by the peripheral zones of the band pass filters in the devices 6 or 9 respectively. Substantial expenditure is called for to compensate for the delay distortions of up to 10 ms which result from the peripheral zones of the aforementioned band pass filters since the width of the complementary frequency bands depends on time. In order to avoid this substantial expenditure it is appropriate to construct this system in accordance with FIG. 1.

Figure 10:
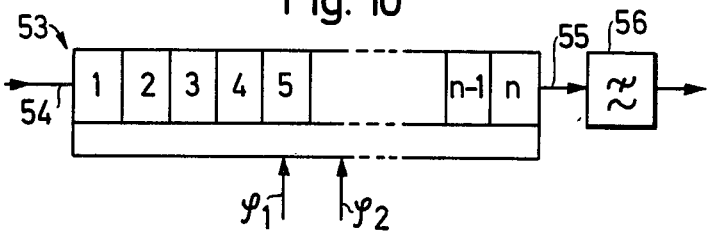
FIG. 10 shows in simplified form the construction of a delay element used in the devices according to FIGS. 6 to 9.

FIG. 10 shows the basic form of a particularly advantageous embodiment of a delay element for the devices which are illustrated in FIGS. 6 and 9. This delay element comprises a shift register 53 for analog signals. i.e. a so called bucket chain store. The principle of such a chain store is that the charge or charge deficit of each capacitor in a chain of such capacitors is transferred to the succeeding capacitor by the command of a transistor switch. The analog signals are stored in the form of a finate sequence of instantaneous values and can again be scanned within specific limits in any desired sequence which is either slower or faster, depending on the timing frequency supplied to the system. The delay between the beginning and end of the chain can be influenced by appropriate selection of the aforementioned frequency and the analog signal can be compressed or expanded with respect to time.

A signal which is supplied to the input 54 of the shift register 53 and whose frequency range has an upper limiting frequency $f_o$ is scanned at the rhythm of the shift frequency $f_s$, subject to the condition that $f_2 \geqq 2f_o$. During the scanning operation the scanned analog values are shifted from left to right in the capacitative storage elements $l$ to $n$ of the shift register 53. The shift takes place in two phases $\phi_1$ and $\phi_2$ since the individual capacitative storage elements cannot be simultaneously discharged and recharged. Each cycle of the shift frequency is followed by a shift of the analog values by two capacitative storage elements. The total delay of the shift register 53 with $n$ capacitative storage positions therefore amounts to $$\tau = n/2.f_s$$

The number $n$ of the capacitative storage element and the shift frequency $f_s$ for the shift register 53 can be determined from this relationship for a given delay time $\tau$. The individual analog scanning values appear at the output 55 of the shift register 53 at the rhythm of the shift frequency $f_s$ and with a delay of $\tau$. The delayed analog signal which is supplied either to the summating element 33, to the subtracting element 38, to the summing element 43 or to the subtracting element 48 and to the summing element 50 is obtained by means of a low-pass filter 56 whose cut-off frequency is $f_o$.

For a given number $n$ of capacitative storage elements of the shift register 53 the stability and reproducibility of delay which is essential for quanlity in echo compensation in the reception station depends solely on the shift frequency $f_s$. Since the shift frequency $f_s$ is derived from a stable crystal oscillator it follows that the stability of $\tau$ is very good thus ensuring practically complete echo compensation. The following description refers to the method of operation of a second kind of time scrambling device by means of negative echo. By contrast to positive echo this refers to an echo which leads the signal that is to be scrambled and whose amplitude increases with time and is therefore briefly referred to as negative echo.

The basic method of scrambling speech signals solely with negative echo is described in the U.S. Pat. No. 3,255,142. The great disadvantage of this method is due to the substantial signal delay $\tau$ of at least 5 s which is required to achieve effective scrambling. This extensive delay is unsuitable for systems in which duplex operation is required. This disadvantage can be avoided by combining the time scrambling with the frequency scrambling referred to earlier in a device according to FIG. 1. This device has a wide-band characteristic to prevent the parameters of the device 7 for producing the negative echo being directly detectable from the signal which is transmitted via the transmission channel 3.

The basic method of operation of such a device 7 is described hereinbelow with reference to FIG. 11 which shows a greatly simplified circuit. The signal to which a negative echo is to be added is supplied via an input 124 to a delay line 125. The delay line comprises a plurality of tappings 126, for example six, and one output 127. The tappings are arranged so that if a pulse supplied to the input 124, a signal which corresponds to the pulse occurs at each tapping 126 and finally at the output 127, the signals being identical but occurring later from tapping to tapping by a precisely defined time interval $t_o$. Each tapping 126 and the output 127 of the delay line 125 are connected via a separate amplifier 128 to a summing element 129. The amplifier 128 which is connected to the output 127 of the delay line 125 has a gain of $-g$. The amplifiers 128 which are connected from left to right in FIG. 11 to the tappings 126 have the gains $(1-g^2)$, $(1-g^2)g \ldots (1-g^2)g^{n-3}$, $(1-g^2)g^{n-2}$ and $(1-g^2)g^{n-1}$ and in this order. The above mentioned delay time $t_o$ between tappings and the value of $g$ represent the echo parameters.

Figure 11:
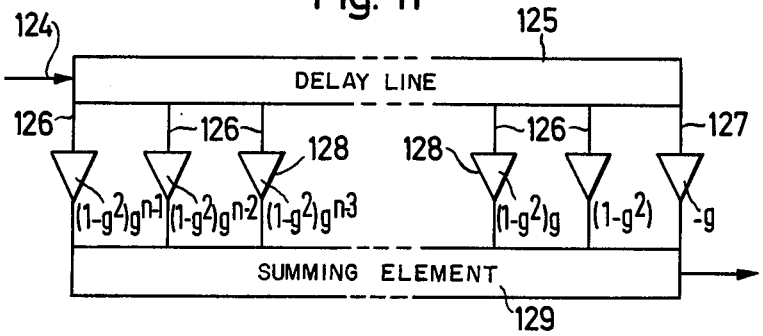
FIG. 11 is a greatly simplified block diagram of a device for generating a negative multiple echo.
Figure 12:
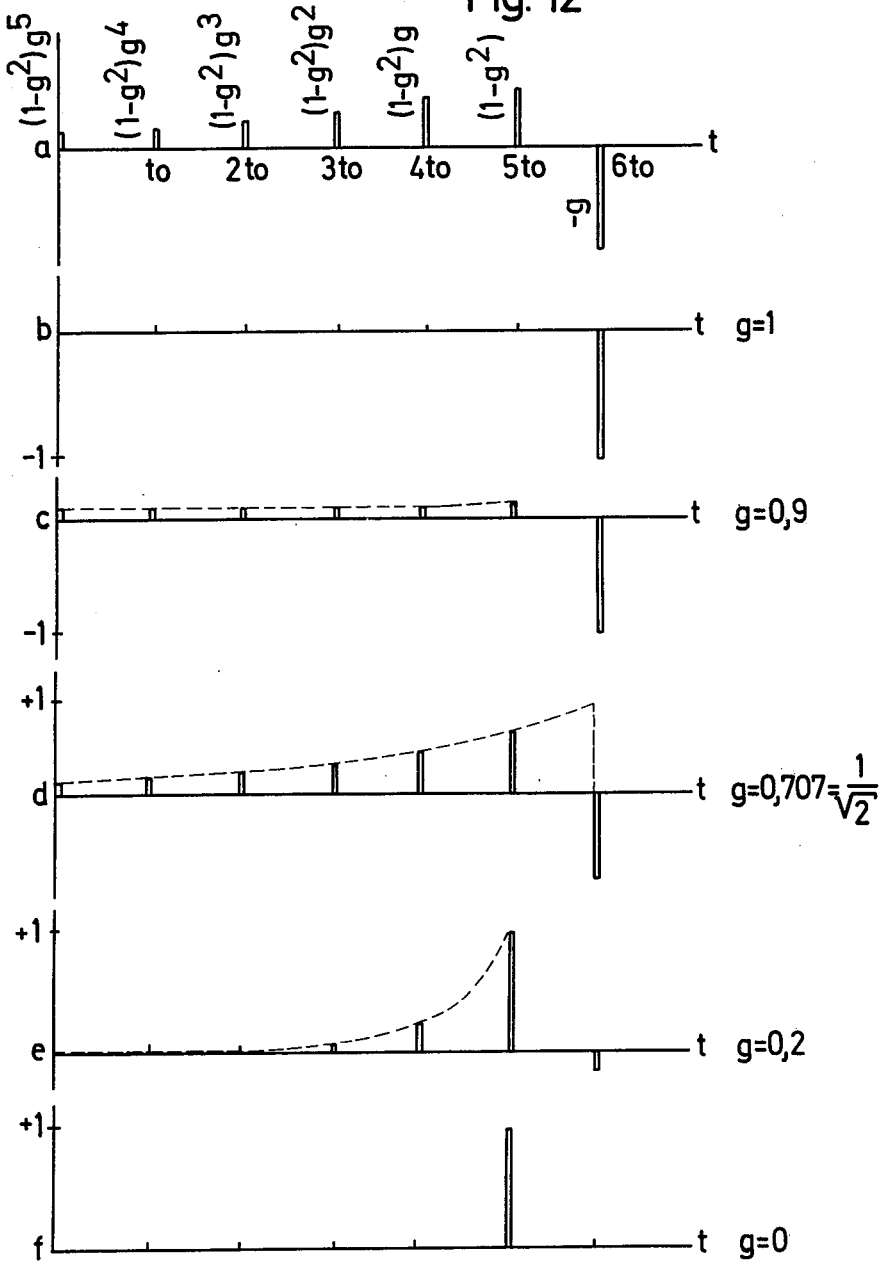
FIG. 12 shows a graph of the output pulse train supplied by the device shown in FIG. 11.

The output pulse train from the circuit shown in FIG. 11 is illustrated in section *a* of FIG. 12. The number $n$ of generated echos in the pulse train is finite for a finite signal delay $\tau = n \times t_o$. In the example illustrated in FIG. 12 $n$ = six. The pulse train from such a circuit as that shown in FIG. 11 for generating negative echo can be represented as follows:

$$H_1(z) = -gz^{-n} + (1-g^2)z^{-n+1} + (1-g^2)gz^{-n+2} + \ldots + (1-g^2)g^{n-2}z^{-1} + (1-g^2)g^{n-1}$$

where $$z = e^{j\omega t_0} \text{ ist}$$

Transformation of the above mentioned equation provides $$H_1(z) = z^{-n}\left(\frac{-g+z}{1-gz} - \frac{(1-g^2)g^n z}{1-gz}\right.$$

Figure 14:
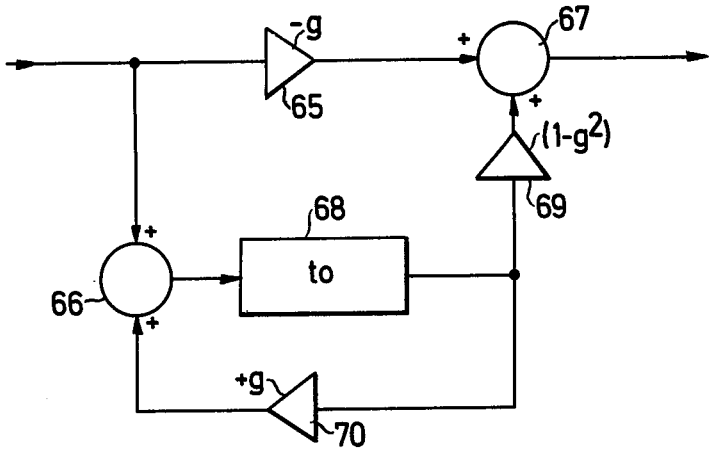
FIG. 14 shows a circuit for compensating a negative multiple echo.
Figure 15:
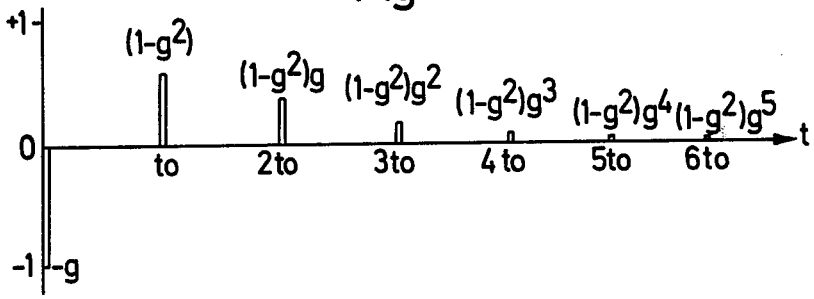
FIG. 15 shows a pulse reply obtained from the circuit shown in FIG. 14.

The device 8 comprising a wide-band inverting circuit is provided to compensate the negative echo which is produced in the device 7 of FIG. 11. An example of such a device is illustrated in FIG. 14. The pulse grain from this device is illustrated in FIG. 15, and it should be noted that the pulse train continues along the time axis $t$ to infinity but the amplitude of the individual echo pulses becomes smaller. The pulse train in FIG. 15 is illustrated only as far as $t = n.t_o = 6\ t_o$. The pulse train which is generated by the device 8 shown in FIG. 14 can be stated as follows:

$$H_2(z) = -g + (1 - g^2)z^{-1} + (1 - g^2)gz^{-2} + (1 - g^2)g^2z^{-3} + \ldots$$

where $$z = e^{j\omega t_o} \text{ ist}$$

The following equation can be derived therefrom by transformation $$H_2(z) = \frac{-g + z^{-1}}{1 - gz}$$

The product of $H_1(z)$ and $H_2(z)$, i.e. the pulse train of the device 7 and of the device 8 which are connected in series as shown in FIGS. 11 and 14 can be expressed as $$H_1(z) \cdot H_2(z) = z^{-n}\left[\frac{-g + z}{1 - gz} - \frac{(1 - g^2)g^n z}{1 - gz}\right]\frac{-g + z^{-1}}{1 - gz}$$

In simplified form this yields $$H_1(z) \cdot H_2(z) = z^{-n} - \frac{(1 - g^2)g^n}{1 - gz^{-1}}$$

The term $z^{-n}$ represents the desired signal which is delayed by $n \times t_o$.

The quotient $$-\frac{(1 - g^2)g^n}{1 - gz^{-1}}$$

represents a preliminary echo with exponential decay which is due to the finite number $n$ of the sections of the delay line 125 of the device shown in FIG. 11 and the corresponding finite length of a negative echo which can be obtained under practical conditions. This preliminary echo can be reduced at will by increasing the number $n$.

It should be noted that only an approximate embodiment can be obtained of a wide-band filter for producing negative echo with available means because by contrast to devices for generating positive echo the number $n$ of the generated echo pulses of the output pulse train is finite if a finite signal delay $\tau$ is desired. The delay $\tau$ of the pulse train from a device for producing a negative echo is preferably made equal to the echo time T which can be defined as the time required for the echo pulses to decay to 1% of the main pulse at the output, corresponding to an attenuation of 40 dB. The total delay $\tau$ is equal to the sum of the delay intervals $t_o$ of each section of the delay line 125 between two tappings 126.

The parameters of the negative echo are defined so that the signal delay $\tau$ does not exceed the maximum permissible value of 0.5 s. It is therefore assumed that the echo time of the device 7 according to FIG. 11 amounts to $$T = \tau = 0.5 \text{ s}$$

The echo time T depends on the echo parameters $t_o$ and $g$.

The effect of the parameter g on the pulse train is plotted in sections $b$ to $f$ of FIG. 12. This shows that each pulse train comprises only a single pulse for both extreme cases in which $g = 1$ (section b of FIG. 12) and $g = 0$ (section $f$ of FIG. 12). It is readily seen that the signal to be transmitted cannot be effectively scrambled in these two extreme cases.

An optimum scrambling effect may be achieved for example if the energy of the main pulse (amplitude $= g$) is equal to the sum of energies of all the negative pulses that is to say leading echo pulses, the echo pulse amplitudes being $(1 - g^2)$, $(1 - g^2)\ g$, $(1 - g^2)\ g^2$ and so on.

$$\frac{P_{NM}}{P_H} = \frac{(1 - g^2)^2(1 + g^2 + g^4 + g^6 + \ldots)}{g^2} = 1$$

$$\frac{(1 - g^2)^2}{g^2}\ \frac{1}{1 - g^2} = \frac{1 - g^2}{g^2} = 1$$

In this case $$g = \pm 1/\sqrt{2}.$$

If the value selected for the echo parameter $g = 1/\sqrt{2} = 0.707$ it means that the amplitudes of the individual echo pulses increase exponentially as illustrated in section $d$ of FIG. 12, the amplitudes of successive echo pulses being differentiated by the factor $1/g = \sqrt{2}$ which is equivalent to an increase of 3dB. The echo time $t$ at which the pulse amplitude has dropped to 1% of the main pulse amounts to $$T = 40\text{dB}/3\text{dB} = 13.3\ t_o.$$

Since the echo time T is to be equal to the permissible total signal delay $\tau$ it is necessary for the following condition to be satisfied $$T = 0.5 \text{ s}.$$

The delay time $t_o$ for each section between two adjacent tappings 126 of the delay time 125 can be calculated as follows $$t_o = 500 \text{ ms}/13.5 = 37.5 \text{ ms}.$$

FIG. 15 shows a first embodiment of a device 7. This device comprises a shift register 58, subdivided into sections 57 and having a number of tappings 59, the shift register being suitable for storing analog signals. The signals which are tapped off by the tappings 57 and the signals which appear at the output of the last section 57 of the shift register 58 pass via separate amplifiers 60 to a summing element 61. The summed signals produced therein are transferred to a low-pass filter 62 and subsequently reach the transmission channel 3. The analog signals which are supplied to the input 63 of the shift register 58 and represent the interchanged inverted frequency bands produced by the device 6 are scanned by the first stage of the first section 57 of the shift register 58 at the shift frequency $f_s$ and the scanned analog values are shifted through the entire shift register 58 in accordance with the aforementioned shift frequency. The oscillator for producing the shift frequency $f_s$ with the two phases $\phi_1$ $\phi_2$ is not shown.

Figure 13:
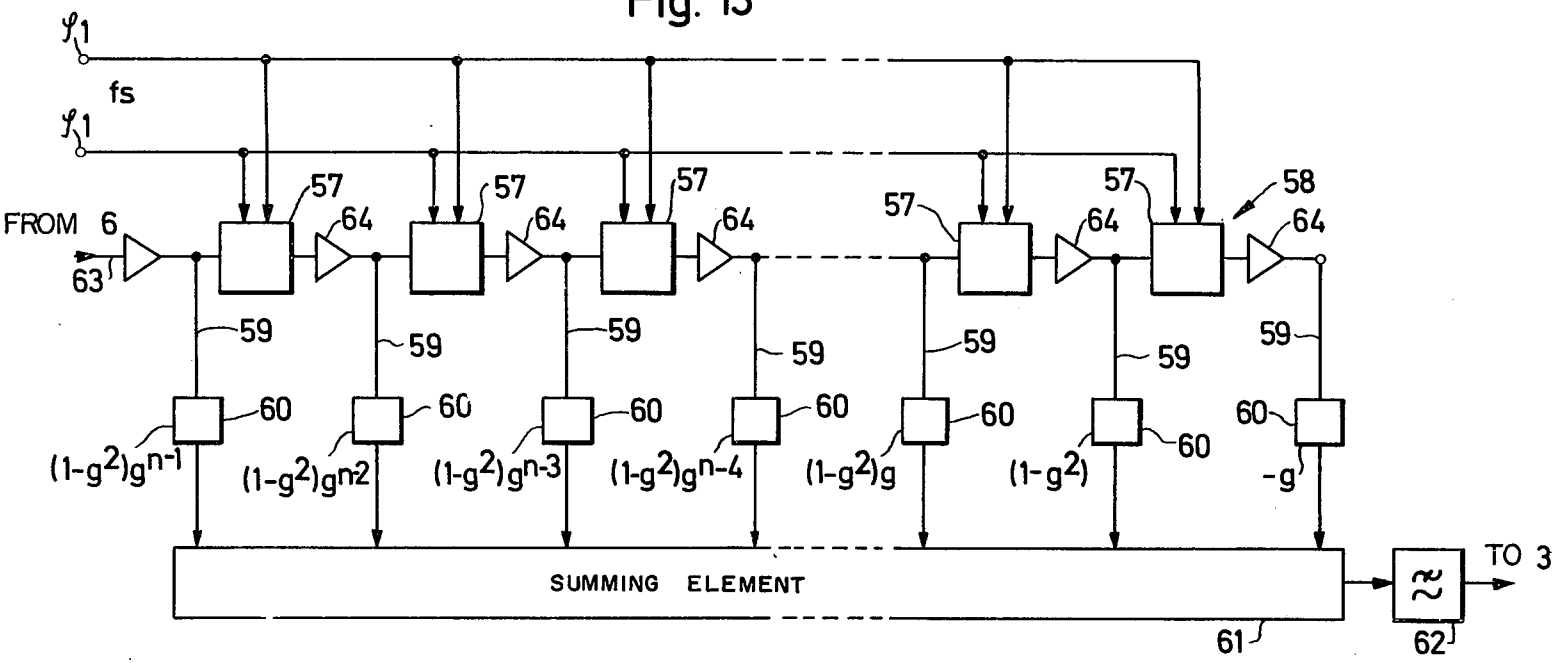
FIG. 13 shows a block diagram of a device for generating a negative multiple echo.

The shift register 58 of FIG. 13 can be utilised for generating the negative echo with the parameters $t_0 =$ 3,75 ms and $g = 0.707$, the shift register having 13 sections 57 and 14 tappings 59. The total delay time $\tau$ amounts to $t_o = 0.4875$ s.

Each individual section 57 of the shift register 58 is associated with an amplifier 64 to compensate for the attenuation losses in each section 57 so that the output signal from the shift register 58 has the same amplitude as that supplied to the input 63.

As already mentioned the shift frequency $f_s$ is supplied to the shift register 58 in two different phases $\phi_1$ and $\phi_2$ and the individual signal components which are added in the summing element 61 are again converted into a continuous analog signal by means of the low-pass filter 62 which has a band width $f_o$ corresponding to half the shift frequency $f_s$. Higher frequency portions of the scaned signal are substantially attentuated. The scrambled signal which is obtained in the manner described above is transferred to the transmission channel 5 and transmitted to the receiving station 4.

Figure 16:
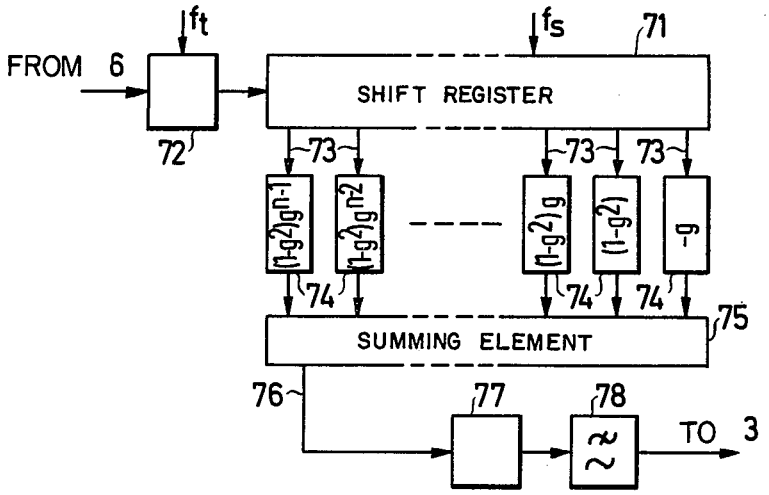
FIG. 16 shows a block circuit diagram of a further embodiment of a time scrambling device 7 for producing a negative multiple echo by means of a digital shift register.

A block circuit diagram of a second embodiment of a device 7 with a shift register 71 for digital signals is illustrated in FIG. 16. The signal which occurs at the output of the device 6 is supplied to an analog/digital converter 72 and scanned at the rhythm of the scanning frequency $f_t$ which is also supplied to the analog/digital converter, the scanning frequency $f_t$ being at least twice the highest frequency which occurs in the analog signal. At the output of the analog/digital converter 72 a digital signal which corresponds to the instantaneous value of the input signal appears on application of a pulse of the scanning frequency and is supplied to the first stage of the shift register 71. The digital information which is individually supplied to the shift register 71 is shifted at the rhythm of the shift frequency $f_s$ which is equal to the scanning frequency $f_t$.

The shift register 71 is provided with a plurality of tappings 75 which are arranged so that a signal which corresponds to the input signal appears at each succeeding tapping only on the elapse of a delay time $t_o$ after the signal which appears at the preceding tapping. Each tapping 73 is connected via a separate multiplier 74 to a summing element 75 which adds all digital signals occurring simultaneously at the output of the multipliers 74, the summed signal being then supplied via a line 76 to a digital/analog converter 77.

The output of the digital analog converter 77 is connected to a low-pass filter 78 which blocks any residual components of the scanning frequency $f_t$ to enable a scrambled analog signal to reach the transmission channel 3.

The number of multipliers 74 can be reduced if the individual multiplications are performed in sequence but additional measures must then be taken by means of which the multiplication factor of the reduced number of multipliers is appropriately altered.

Figure 17:
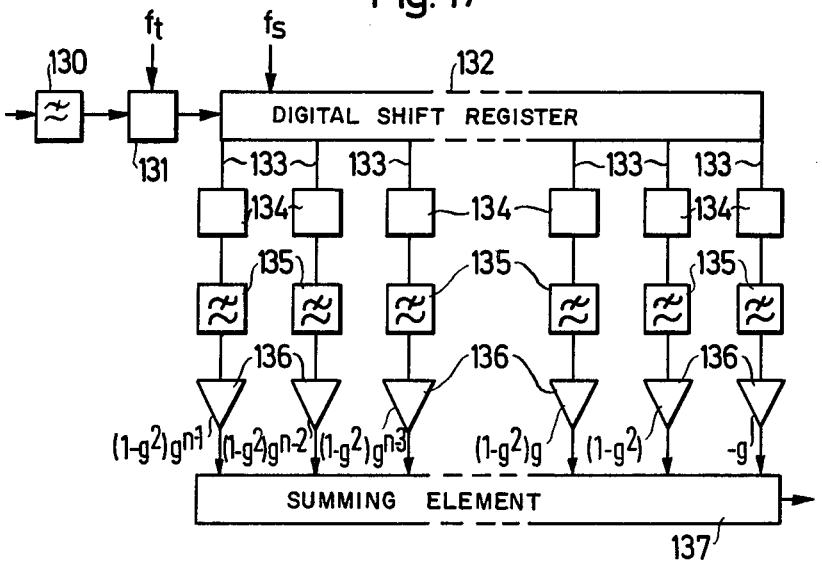
FIG. 17 shows a block diagram of a further embodiment for generating a negative multiple echo by means of a digital shift register and the application of delta modulation.

FIG. 17 shows a block diagram of a third embodiment of a device 7. The input signal of this device is supplied via a low-pass filter 130 in order to limit the spectrum of the input signal substantially to the bandwidth of the transmission channel 3, no stringent requirements being made on the steepness of the aforementioned low-pass filter 130. The filtered analog input signal is delta modulated in a delta modulator 131 at the scanning frequency $f_t$ and is then supplied to a digital shift register 132 in which it is shifted at the shift frequency $f_s$. The scanning frequency $f_t$ and the shift frequency $f_s$ are identical and are preferably between 20 and 60 kHz for the conventional speech band width of the transmission channel 3. The shift register 132 has $n + 1$ tappings 133 and is arranged so that the signal is delayed between two adjacent tappings 133 by $t_o$. A sift frequency $f_s$ calls for $m = t_o \cdot f_s$ binary store positions between two tappings 133 of the shift register 132.

A delta modulator 134 is connected to each tapping 133. Simple integrators can be employed as delta modulators 133. Analog signals, which are supplied to further low-pass filters 135 which have the same band width as the low-pass filter 130 and are adapted to block the shift frequency $f_s$ and its harmonics appear at the output of the delta modulators 133. The filtered analog signals pass via amplifier 136 into a summing element 137, each amplifier 136 having a gain such as that indicated in FIG. 17. The device shown in this illustration represents a wide-band circuit for generating a negative multiple echo, signal delay being obtained by conversion of the analog input signals into a digital signal by delta modulation followed by delay in the digital shift register 132, the digital signals then being reconverted into analog signals by delta modulation.

Compared with the embodiment described with reference to FIG. 16 the embodiment described with reference to FIG. 17 offers the following advantages:

The delta modulator 131 which is used in place of the analog/digital converter 72 is simpler and less costly to produce than the latter.

Since the delta modulators 134 which are connected to each tapping 133 are simple integrators a complete parallel system can be obtained by the provision of a delta demodulator as digital/analog converter in each tapping branch, thus greatly simplifying the organisation of the operating routine.

The negative multiple echo which is generated by the device 7 in accordance with one of the embodiments illustrated in FIGS. 13, 16 or 17 and is to be added to the signal for transmission is compensated by means of the device 8 in the receiving station 4. A simple block diagram of such device 8 is illustrated in FIG. 14. The pulse train produced by this circuit is plotted in FIG. 15 in such a way that it corresponds approximately to the parameter $g = 0.707$. Apart from the variation of the time axis $t$ precise coincidence will be found in comparing FIG. 15 with section *a* of FIG. 12. The circuit according to FIG. 14 has the same parameters $t_o$ and $g$ as the negative multiple echo which is generated by the devices that are illustrated in FIGS. 13, 16 or 17. A signal which is supplied to the circuit passes to an amplifier 65 with a gain of $-g$ and to a summing element 66.

The signal passes without delay but with reversed sign via the amplifier 65 to a further summing element 67 and via the summing element 66, via a delay element 68 and via a further amplifier 69 to a further summing element 67 after being delayed by the delay $t_o$ of the delay element 68. In this way the negative pulse appears at the time $t = 0$ and the first positive pulse appears at the time $t = t_o$ at the output of the summing element 67 as may be seen in FIG. 15. The signal which appears at the output of the delay element 68 is then fed back to the summing element 66 via an amplifier 70 with a gain of $g$ and thus reaches the input of the delay element 68 in attentuated form because the gain $g$ is generally $< 1$. After the delay $t_o$ has elapsed this signal again appears at the output of the delay elements 68 and passes via the amplifier 69 to the summing element 67 so that the second positive pulse occurs at the time $t = 2t_o$ as shown in FIG. 15 at the output of the summing element 67.

The above described process continues accompanied by a rapid reduction of the amplitude of the pulses which appear at the output of the summating element 67.

The delay element 68 of the circuit illustrated in FIG. 15 may comprise a shift register 53 such as that described earlier with reference to FIG. 10. Instead of the above mentioned devices using a shift register for analog signals it is possible for devices adapted to generate and compensate negative or positive echos to contain shift registers for digital signals.

Figure 18:
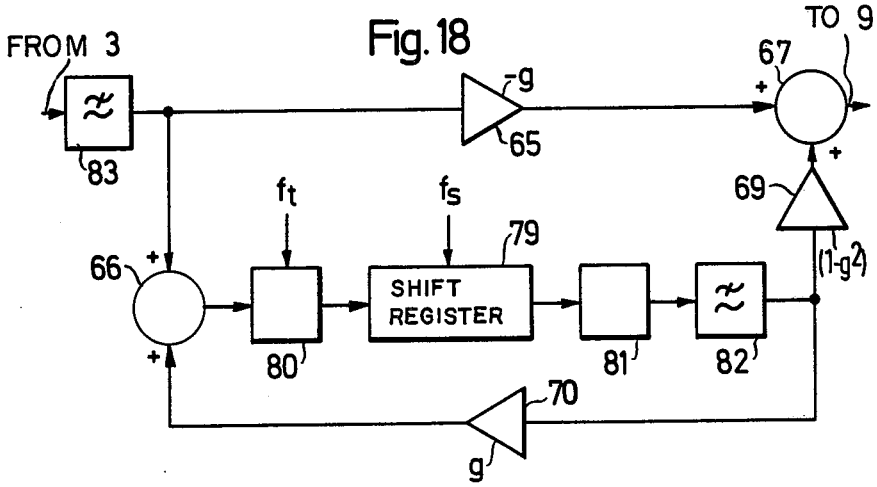
FIG. 18 shows a block diagram of a further embodiment of a time unscrambling device 8 for compensating the negative multiple echo by means of a digital shift register.

FIG. 18 shows a block circuit diagram of one embodiment of the device 8 for compensating a negative multiple echo. The circuit shown in FIG. 18 corresponds substantially to that illustrated in FIG. 14. Parts performing the same functions are provided with the same reference numerals. Instead of the delay element 68 in FIG. 14 the circuit shown in FIG. 18 is provided with an analog/digital converter 80, a shift register 79, a digital/analog converter 81, and with a low-pass filter 82. The circuit also incorporates a further low-pass filter 81 which limits the frequency of the transmitted signal to $f_o = f_{\sqrt{2}}, f_{\backslash} = f_t$.

Figure 20:
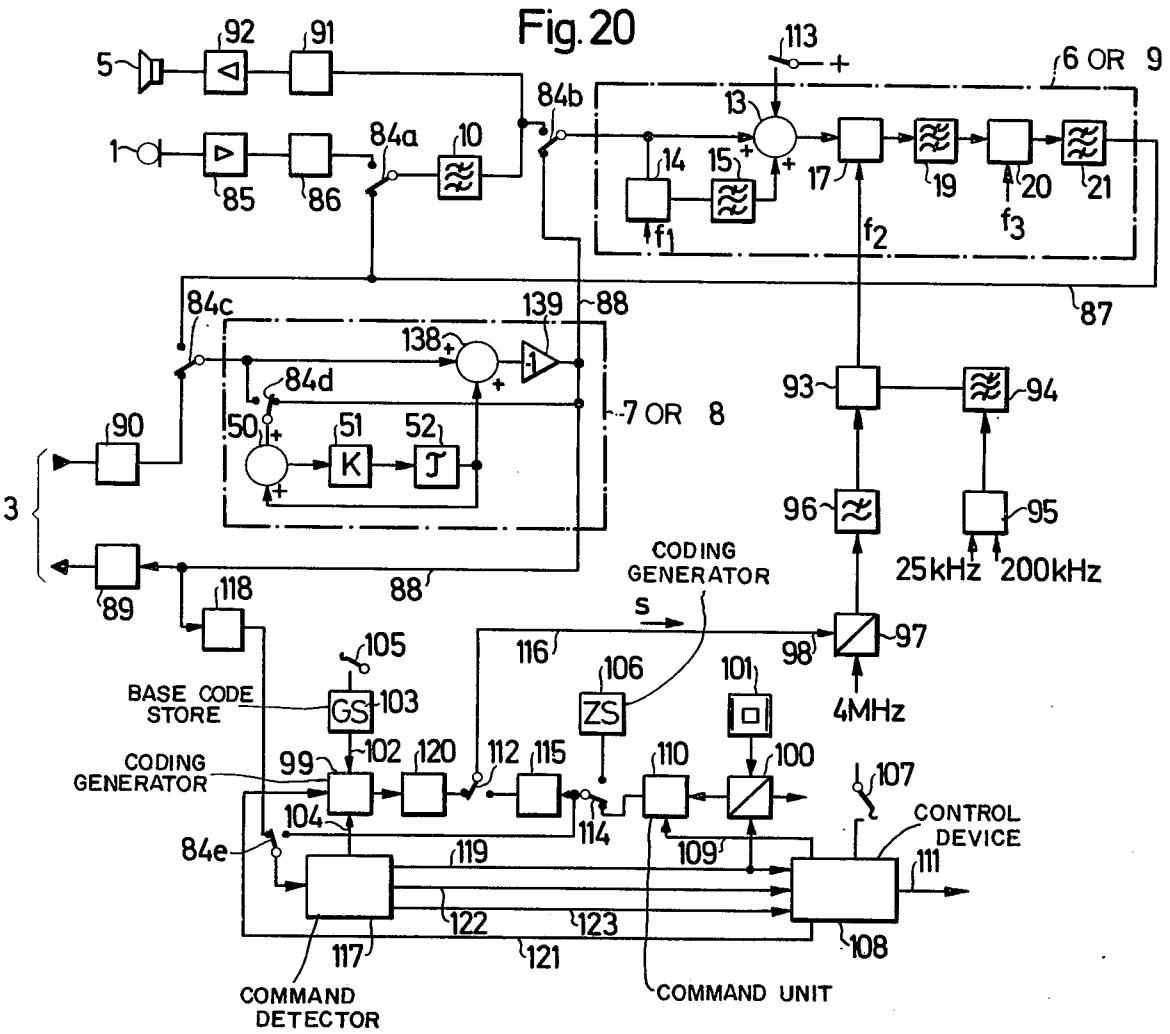
FIG. 20 shows a block circuit diagram of a station which can be switched by means of a speech key from reception to transmission and vice versa.

FIG. 20 shows a block diagram of a transmitting-/receiving station which can be switched from transmission to reception or vice versa by means of a five-pole selector switch 84*a* to 84*e*. Two such stations comprise a complete system for the scrambled transmission of speech signals.

The SE selector switches 84*a*–84*e* are illustrated in FIG. 20 in the reception position. It may be assumed that the SE selector switches have been switched to transmission in a manner which is to be described below. Electrical speech signals generated by the microphone 1 are amplified in a microphone amplifier 85 with amplitude control, passed to a pre-emphasis network 86, whose output is connected to the SE selector switch 84*a*, the movable contact being coupled to the input filter 10 where output is connected to the SE selector switch 84*b*, the movable contact of which is coupled to the device 6 or 9 respectively which functions as device 6 when it is in the transmitting state. This device is described above with reference to FIG. 2 and parts having the same functions are provided with the same reference numerals. The signal which appears at the output of the device 6 and corresponds to the complementary inverted speech bands is supplied via line 87 and via the SE selector switches 84*c* to the device 7 or 8 respectively which functions as a device 7 when it is in the transmitting state. If the SE selector switch 84*d* is in a position opposite to that shown in FIG. 20 the device will produce a positive multiple echo in a manner similar to that of the circuits described with reference to FIG. 8, all the echos being compensated in a similar manner when the SE selector switch 84*d* is in the illustrated position as described with reference to FIG. 9.

The attenuation element 51, the delay element 52 and the summing element 50 have the same functions as corresponding parts of FIG. 9 and these parts are therefore provided with the same reference numerals. The device reference 7 or 8 in FIG. 20 is provided with a further summing element 138 and an inverter 139 to enable it to be used for generating as well as compensating the multiple echo.

The output of the device 7, at which the scrambled transmission signal occurs, is connected via a line 88 and a matching network 89 to the AF input of a radio station which forms part of the radio transmission channel 3.

The signal which is transmitted by the transmission channel 3 is received at a station which is identical to the station illustrated in FIG. 20. The received, scrambled transmission signal passes via a matching network 90 and the SE selector switch 84*c*, which is in the reception position, to the device 8. Since the SE selector switch 84*d* is in the position illustrated in FIG. 20 the device 8 will regenerate a positive multiple echo from the scrambled signal supplied to it and will subtract the regenerated echo from this signal. This is performed in a manner similar to that described above in principle with reference to FIG. 9.

The signal which has had the echo removed passes from the output of device 8 via the line 88, the selector switch 84*b* to the device 9 which reverses the frequency band shift and inversions that were performed at the transmitting station. The signal that appears at the output of the device 9 corresponds substantially to the analog speech signal which was generated by the microphone 1 in the transmitting station and is transferred via the line 87, the SE selector switch 84*a*, the input filter 10, a de-emphasis network 91 and a power amplifier 92 to the acoustic transducer 5.

As already mentioned with reference to FIGS. 2 to 5, the second modulator 17 or 25 respectively of the device 6 is supplied with a carrier frequency $F^{-2}$ or $F^{-5}$ and $F^{-6}$ respectively, the frequency of the carriers depending on the control signal $s$ so that the complementary frequency bands are shifted in discrete time steps as a function of the control signal $s$.

It is evident that the control signal $s$ of the transmitting station must correspond accurately to the control signal $s$ in the receiving station if the frequency band shift and inversion are to exactly correspond in both stations.

The variable carrier frequency $f_2$ for the second modulator 17 is generated by means of a modulator 93 which is supplied with a frequency of 175 kHz from a band pass filter 94 that is adapted to filter this frequency from a frequency mixture produced in the mixer 95, the mixture being produced by supplying the two frequencies of 25 kHz and 200 kHz to the aforementioned mixer and the modulator also being supplied through a low-pass filter 96 with a frequency which can be varied in discrete steps by means of a controllable frequency divider 97, the duration of scrambling intervals preferably being 20 to 100 ms.

The digital control signal $s$ is supplied to the five inputs 98 of the controllable frequency divider 97, only one of the inputs being illustrated. The control signal $s$ is generated by a coding generator 99, each control signal $s$ having, for example, five bits which are applied to the individual inputs in parallel. Each control signal $s$ is stored in the frequency divider until a fresh control signal $s$ is entered to represent a numerical value of 0 to 31. The dividing factor $k$ of the frequency divider 97 may therefore have 15 different values between 184 and 202 depending on the control signal $s$, if only even-numbered dividing factors $k$ are permitted. To scramble the speech signal the dividing factors $k$ are selected so that the separation between the upper side bands 12' and 12", see section *d* of FIG. 3, always remain within the band width of the output filter 21.

The carrier frequencies $f_1$ and $f_2$ required for driving the first modulator 14 and the third modulator 20 and the frequencies of 4 MHz, 200 kHz and 25 kHz required for driving the controllable frequency divider 97 and the mixer 95, are supplied by a further frequency divider 100 which in turn is connected to a crystal-controlled fundamental frequency generator 101 adapted to generate a frequency 8 MHz. The frequency divider 100 also supplies the timing pulses which are required to operate the coding generator 99 and, where appropriate, supplies the shift pulses which are required for the operation of the shift register 58 or 71 respectively if a device 7 or 8 respectively is used in accordance with FIGS. 13, 16 or 17.

Reliable operation of the system of FIG. 20 demands that the control signal *s* in the transmitting station and in the receiving station correspond to each other, that is to say that they are identical but shifted with respect to each other by the mean transit time of the transmission channel 3 and, where appropriate, are shifted with respect to each other by the amount of time to which these signals are delayed in device 8 when a circuit according to FIGS. 13, 16 or 17 is used.

The control signal S is not transmitted via the transmission line 3 because it contains the unscrambling code. The control signal *s* is therefore generated by individual coding generators 99 in the transmission and reception stations. A coding generator of this kind is described, for example, in the Swiss patent specificaion No. 408,109. If the coding pulses are generated in both coding generators 99 in accordance with identical rules and in identically constructed coding pulse generators whose coding program is defined by their initial state it will be possible for the identity of such an initial state to be achieved in accordance with the principle which is disclosed in the Swiss patent specification No. 402,937.

The generator 99 has a first input 102 for receiving a base code which is stored in a base code store 103 and a second input 104 for receiving a supplementary code. The base code can be varied by means of a keyboard which is symbolized by a single key 105, it being understood that the same base code setting is performed in both stations. Prior to each transmission, i.e. preferably after each change from receiving to transmitting, the supplementary code that is generated in a supplementary coding generator 106 is transmitted from the transmitting station to the receiving station in the manner described hereinbelow.

Figure 19:
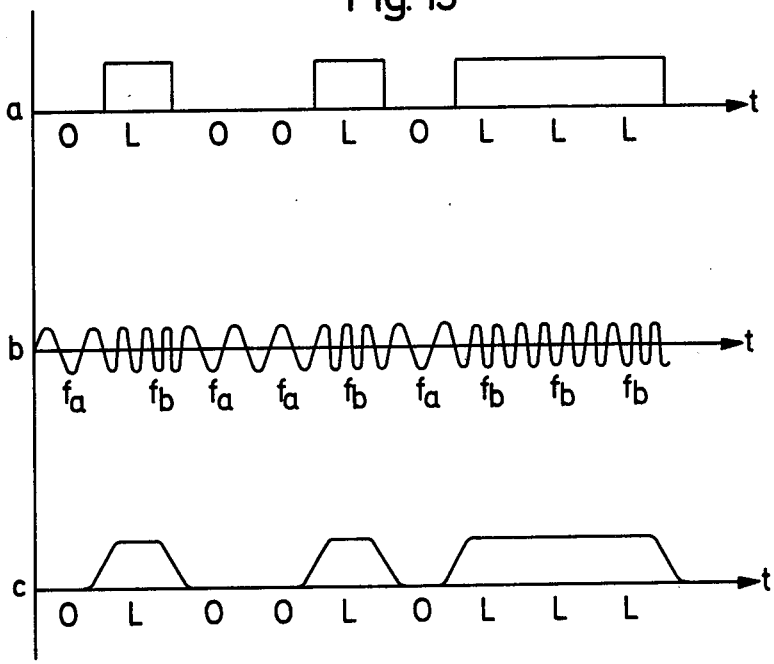
FIG. 19 is a graph of a command signal which is transmitted from the transmitting station to the receiving station.

Operation of a speech key 107 causes a control device 108 to be switched on and this delivers a starting signal via a line 109 to a command unit 110. A relay which is not shown and operates the SE selector switches 84*a*-84*e*, an electronic selector switch 112 which is also not shown and an electronic switch 113 are simultaneously controlled via output lines of which only one, namely 111, is shown in the interests of simplicity. Only one selector switch 112 is illustrated in FIG. 20 in the interests of simplicity but in actual fact five such selector switches 112 are provided in accordance with the five inputs 98 of the controllable frequency divider 97. When triggered by the start signal the command unit 110 generates a digital synchronizing command signal which may comprise a pulse sequence of 63 bits. Part of such a command signal is illustrated in section *a* of FIG. 19. The synchronizing command signal passes from the command unit 110 via an electronic selector switch 114 to a serial to parallel converter 115, via the electronic selector switch or switches 112 and a five-core line 116 to the inputs 98 pf the controllable frequency divider 97. The parallel binary signals which arrive at the aforementioned inputs 98 influence the dividing factor *k* of the controllable frequency divider 97, the dividing factor *k* having a value of for example 168 in the presence of a binary "0" at the output of the command unit 100 and having the value for example, 172, if a binary "1" is present at the output of the command unit 100. The carrier frequency $f_2$ supplied to the second modulator 17 in the first case is 198, 810 kHz and in the second case is 198.256 kHz. These carrier frequencies are within the pass range of the band pass filter 19. The input of the modulator 17 is supplied with a d.c. voltage via the NO contact 113 and via the interconnecting element 13 to enable these frequencies to appear at the output of the modulator 17 but this disturbs the symmetry of the modulator 17 and the carrier frequency $f_2$ is no longer suppressed. The above mentioned carrier frequencies $f_2$ alternately and in dependence on the synchronising command signal reach the third modulator 20 where the frequencies are converted, for example into AF signals $f_a = 1190$ Hz and $f_b = 1744$ Hz as indicated in exaggerated form in section *b* of FIG. 19. The above described generation of the AF signals for command transmission is performed by simple means within the device 6 so that no additional devices are required for generating the aforementioned AF signals. These AF signals then pass via the line 87 and the actuated SE selector switch 84*c* into the device 7 in which an echo is added to the aforementioned AF signals. The AF signals which are provided with an echo finally pass via the line 88 and the matching network 89 to the radio station which is not shown and they are then transmitted to the other station via the transmission channel 3. The synchronizing command signal which is generated by the command unit 110 passes to a command detector 117 in addition to reaching the controllable frequency divider 97 via the electronic selector switch 114 and the actuated SE selector switch 84*e*. The AF signals which are provided with an echo and are received by the other station via the transmission channel 3 are supplied by the matching network 90 via the SE selector switch 84*c* to the device 8 in order that the echo may be removed. The AF signals from which the echo has been removed then pass via the line 88 to a twin-frequency signal receiver 118 which reconverts the two AF signals into a binary signal sequence which is illustrated in section *c* of FIG. 19. This signal sequence, which corresponds to the synchronizing command signal that is generated by the command unit 110 of the transmitting station, is then supplied via the SE selector switch 84*e* to the command detector 117 of the receiving station. The command signal detectors of the transmitting and receiving stations each produce a synchronizing pulse on the basis of the received synchronizing command signal, the synchronizing pulse passing via a line 119 to the corresponding frequency divider in order to ensure phase matching of the timing pulses produced by the detectors.

The electronic selector switch 114 is actuated as soon as the synchronizing pulse arrives via the line 119 at the control device 108 of the transmitting station. As a consequence the supplementary coding generator 106 is connected via the selector switch 114 to the input of the serial to parallel converter 115. The signal sequence that is generated by the supplementary coding generator 106 and represents the supplementary code can have, for example, 21 bits and is preferably transmitted three times. In the serial to parallel converter 115 the aforementioned signal sequence is supplied to the controllable frequency divider 97 in the same manner as that described earlier with respect to the synchronizing instruction and is thus transmitted to the other station. The signal sequence which represents the supplementary code reaches the command signal detector of the transmitting station and the command signal detector 117 of the receiving station as already mentioned with reference to the synchronizing command signal. The supplementary code then passes from the command signal detector 117 via the second input 104 into the corresponding code generator 99. Repeated transmission of the signal sequence which represents the supplementary code and comparison between the received signal sequences enables any transmission faults to be eliminated.

After the supplementary code has been transmitted three times the control device 108 restores the electronic selector switch 112 into the position illustrated in FIG. 20 and switches off the electronic switch 113. As a consequence the inputs 98 are connected to a further serial to parallel converter 120 which is connected to the coding generator 99. The coding generator 99 is started via a line 121 and the initial position of the coding generator is accurately defined by the base code that is generated by the base code store 103 and the supplementary code which is received by the command signal detector 117. From this moment onward the coding generator 99 of the transmitting station and of the receiving station generates the control signal $s$ which is supplied by the electronic selector switches 112 to the inputs 98 of the controllable frequency divider 97. The starting times of the coding generators are shifted with respect to each other by the transmit time of the transmission channel 3 and where appropriate by the delay time of the device 7.

Further commands, for example an answering command when the speech button is released, can be transmitted from the transmitting station to the receiving station to control the operating routine in like manner. The above described synchronizing operation and the transmission of the signal sequence which corresponds to the supplementary code is preferably performed with each change of transmission direction at the beginning of speech transmission. To limit expenditure no re-synchronization takes place during uninterrupted speech in one direction. The maximum possible uninterrupted speech duration in the same direction therefore depends on the stability of the crystal oscillators employed in the system.

The reply command is also generated by the command signal unit 110 when called upon to do so by the control device 108. The reply command is transmitted to the other station in the same manner as the synchronizing command and is received by the command signal detector 117 of the other station. The command signal detector then delivers a reply pulse via the line 122 to the control device 108 of the other station and initiates the above described processes such as the transmission of the synchronizing command and of the supplementary code in the opposite direction.

The shift registers 53, 58, 71, 70 or 132 contain residual information for a long time, i.e. for one second or more if devices 7 or 8 respectively are used which operate with positive or negative multiple echo. The residual portions have a detrimental effect if the information exchange is subject to a rapid change of direction. The control device 108 therefore ensures that the residual information in the shift registers is cancelled when the reply pulse arrives via the line 122. This may be achieved if the input of the shift registers is short circuited for a time which is equal to at least that which is required by a signal to pass through the shift register.

On completion of information exchange the control device causes the command signal 110 to generate a closing command signal which is transmitted to the other station in the same way as the synchronizing command signal. The closing command signal is received by the command signal detector 117 of the receiving station and of the transmitting station whereupon a pulse passes via a line 123 to the appropriate control devices 108. These will then ensure that the two stations are shut down.

In the above described different embodiments of the system, the control signal $s$ varies only one carrier frequency which is supplied to one of the modulators of the devices 6. The echo parameters can also be varied with respect to time in order to increase the cryptological reliability. If shift registers are used as delay elements in the devices 7 as is the case in the embodiments illustrated in FIGS. 6 to 10, 13, 16, 17 and 18 it is possible for the parameter $\tau$ or $t_0$ to be altered by modifying the shift frequency $f_s$. Varying the shift frequency $f_s$ by only 1% achieves a surprisingly large additional scrambling effect. The shift frequency $f_s$ can be varied by a second control signal which is derived from the coding generator. A signal which is statistically independent of the first control signal is preferably used as second control signal. In a preferred embodiment the shift frequency $f_s$ is switched between discrete values at fixed intervals of time by means of the second control signal.

If the dividing factors of the frequency divider 97 that is described with reference to FIG. 20 are selected so that the values of the carrier frequency $f_2$ which is supplied to the modulator 17 are such that the complementary frequency bands of the lower side band are filtered out by the band pass filter 19 it is also possible for the number of variations to be substantially increased, the complementary frequency bands being alternately transmitted in the normal or inverse position, depending on the control signal $s$, during speech transmission.

We claim:

1. A method for scrambling, transmitting, receiving and unscrambling speech information, comprising scrambling the speech information with respect to frequency so as to produce an intermediate signal by selecting a given band of frequencies from the speech information, generating a first control signal, dividing said given band into two complementary subbands having a band width ratio which varies as a function of the first control signal and exchanging the subbands within said given frequency band;

scrambling the thus produced intermediate signal with respect to time so as to produce a further scrambled signal by deducing at least one echo signal from the intermediate signal and adding it to the intermediate signal with time lags;

transmitting the further scrambled signal via a telephony channel and receiving it;

unscrambling the received signal with respect to time so as to recover the intermediate signal by providing time lags so as to recover the echo signal from the received signal and subtracting the echo signal from the latter; and unscrambling the thus recovered intermediate signal with respect to frequency so as to recover the speech information by generating a second control signal identical to the first control signal and submitting the intermediate signal to the same steps as the speech information was submitted to when scrambled to produce the intermediate signal, thereby using said second control signal instead of said first control signal.

2. The method according to claim 1, wherein scrambling with respect to the further comprises generating a third control signal and varying the time lags as a function of said third control signal, and wherein unscrambling with respect to time further comprises generating a fourth control signal which is identical to the third control signal and varying the time lags as a function of said fourth control signal.

3. The method according to Claim 2, wherein the first and the third control signal and the second and the fourth control signal are deduced from a first and a second code signal, respectively.

4. A method of scrambling speech information over a telephonic channel, wherein at the transmitting end there are carried out the following steps of:

a. selecting from the speech information a given band of frequencies, b. generating a first control signal, c. dividing said given band into two complementary subbands having a band width ratio which varies as a function of the first control signal, d. exchanging the subbands within said given frequency band, e. adding to the signal formed in accordance with step (d) at least one supplementary signal which is dependent thereon with time lags produced by means of a second control signal, f. subsequently transmitting the scrambled signal formed in accordance with steps (a) to (e) via the telephonic channel, and wherein at the receiving end there are carried out the steps of:

aa. generating a third control signal which is identical with the second control signal, bb. producing time lags by means of the third control signal, cc. recovering the supplementary signal by using the time lags produced in accordance with step (bb) from the scrambled signal arriving via the telephonic channel and subtracting the recovered supplementary signal from the scrambled signal, dd. generating a fourth control signal which is identical with the first control signal, ee. recovering a speech information which is at least similar to the original speech information from the remaining signal of step (cc) by performing the steps (a), (c) and (d), and using the fourth control signal instead of the first control signal.

5. A method according to claim 4 wherein the speech band is divided into two complementary frequency bands which are interchanged by modulating the original speech band with a first carrier frequency and adding the upper side band of the first modulation produce to the original speech band, modulating the original band and the added upper side band with a second carrier frequency which depends on said first control signal, filtering out of the lower and upper side band of the second modulation product that part of the upper side band produced by the first modulation and the complementary part thereof of the original speech band that is produced by the second modulation, and modulating the filtered out frequency bands with a third carrier frequency to generate a modulation product of the interchanged filtered out frequency bands within the band width of the telephony channel.

6. A method according to claim 4 wherein the speech band is divided into two complementary frequency bands which are interchanged by modulating the original band with a first carrier frequency, filtering out the lower side band from the modulation product and modulating it with two carrier frequencies depending on said first control signal and whose difference in frequency corresponds to the band width of the speech band that is to be transmitted, filtering out the lower and upper side bands of the double modulation product and modulating the filtered out lower and upper side bands with the first carrier frequency to generate a modulation product within the band width of the telephony channel.

7. A method according to claim 4 including generating from the signal formed according to step (d) a multiple positive or negative echo to form said supplementary signal.

8. A method according to claim 7 including defining the time interval between individual echos by applying the signal formed in accordance with step (d) to a shift register and shifting said latter signal through the shift register by application thereto of a shift frequency to produce individual time spaced echos from the stages of the shift register.

9. A method according to claim 8 including varying the shift frequency in time steps by means of a further control signal.

10. A method according to claim 9 including generating the time-variable shift frequency by modifying the dividing factor of a frequency dividing system in dependence on said further control signal.

11. A method according to claim 7 including attenuating the amplitudes of successive echos by the factor $\sqrt{2}$.

12. A method according to claim 5 including producing the second carrier frequency signal by modifying the dividing factor of a frequency dividing system in dependence on said first control signal and generating two frequencies required for command transmission by supplying the modulator driven by the carrier frequency that depends on the first control signal alternately with carrier frequencies within the pass range of the band pass filter which is connected downstream of the modulator which is rendered unbalanced during command transmission.

13. A method according to claim 12 including adding at least one positive or negative echo to the double frequency signal.

14. A method according to claim 6 including producing said two carrier frequencies depending on said first control signal by modifying the dividing factor of a frequency dividing system in dependence on said first control signal and generating two frequencies required for command transmission by supplying the modulator driven by the carrier frequency that depends on the first control signal alternately with carrier frequencies within the pass range of the band pass filter which is connected downstream of the modulator which is rendered unbalanced during command transmission.

15. Apparatus for transmitting and receiving speech, comprising a transmitting station having a modulating device generating from the speech band two interchanged complementary frequency bands disposed within the band width of a telephony channel and a first time scrambling device for adding at least one positive or negative echo to the modulation product which appears at the output of the modulating device to provide a scrambled signal for transmission on the telephony channel; said apparatus further including a receiver having a second time scrambling device for regenerating the echo from the received scrambled signal and subtracting it from the received scrambled signal and a demodulating device demodulating the signal from which the echo has been subtracted and converting the demodulated product into a signal similar to the speech signal.

16. The apparatus according to claim 15 wherein the transmitting station further comprises a first means for generating a first code signal for controlling the modulating device so as to vary the ratio of the band widths of said complementary frequency subbands and for controlling the time scrambling device so as to vary the time lags as a function of said first code signal; and wherein the receiver further includes a second means for generating a second code signal which is identical to the first code signal for controlling the time unscrambling device and the demodulating device.

17. The apparatus according to claim 16 wherein said first and second code signal generating means each comprise a coding generator.

18. Apparatus for transmitting and receiving speech, comprising a transmitting station having a modulating device generating from the speech band two interchanged complementary frequency subbands disposed within the band width of a telephony channel, a time scrambling device for adding with given time lags between each other at least one positive or negative echo to the modulation product which appears at the output of the modulating device to provide a scrambled signal for transmission on the telephony channel, and a first means for generating a first code signal for controlling the modulating device so as to vary the ratio of the band widths of said complementary frequency subbands and for controlling the time scrambling device so as to vary the time lags as a function of said first code signal; said apparatus further including a receiver having a time unscrambling device for regenerating the echo from the received scrambled signal and subtracting it from the received scrambled signal, a demodulating device demodulating the signal from which the echo has been subtracted and converting the demodulated product into a signal at least similar to the speech signal, and a second means for generating a second code signal which is identical to the first code signal for controlling the time unscrambling device and the demodulating device.

19. The apparatus according to claim 18 wherein said first and second code signal generating means each comprise a coding generator.

20. Apparatus according to claim 18 wherein the modulating device and the demodulating device each comprise a first modulator for shifting an original band of frequencies applied to it into a frequency band adjoining the original band, interconnecting circuit means for adding the original band and the frequency shifted original band, a second modulator for modulating the added original band and the shifted original band, a device responsive to said first code signal for controlling generation of the carrier frequency for the second modulator, a band-pass filter connected to the output of the second modulator for filtering out one of the side bands of the second modulation product, and a third modulator connected to the output of the band pass filter for shifting said latter frequency band into the transmission band of the telephony channel.

21. Apparatus according to claim 18 wherein the modulating device and the demodulating device are each provided with a first modulator for modulating an original band of frequencies applied to it, a first band pass filter for filtering out one of the side bands of the modulation product, a second modulator for producing two carrier frequencies shifted with respect to each other by the band width of the first band pass filter, a double modulator operated by said two carrier frequencies simultaneously for modulating the side band passed by said first band pass filter, a second band pass filter for filtering out a frequency band from the modulation product of the double modulator and a third modulator for shifting said latter frequency band into the transmission band of the telephony channel, and wherein the first and the third modulators operate with the same carrier frequency and the first and the second band pass filter have the same band-pass characteristic, said apparatus further including means for supplying the second modulator with a constant low-frequency signal and a carrier frequency which depends on their respective code signal so that the sum and difference frequencies of the constant low frequency and of the carrier frequency are produced at the output of the said second modulator.

22. Apparatus according to claim 18 wherein the first time scrambling device comprises a first shift register for delaying the echo signals and a summing element for adding the echo signals to the modulation product and the second time scrambling device for subtracting an echo signal from the received scrambled signal comprises a second shift register.

23. Apparatus according to claim 22 including means at the transmitting station and at the receiver for generating a shift frequency which depends on a further code signal for operating the first and second shift register respectively.

24. Apparatus according to claim 23 wherein the means for generating this shift frequency comprises a frequency divider whose dividing factor depends on a third code signal.

25. Apparatus according to claim 22 wherein the first shift register comprises a bucket chain store with a plurality of capacitative storage positions for storing analog instantaneous values scanned from the modulation product at the rhythm of the shift frequency.

26. Apparatus according to claim 22 wherein the second shift register is a digital shift register, said receiver further including an analog-to-digital converter connected to the input of said second shift register and a digital-to-analog converter connected to the output of said second shift register.

27. Apparatus according to claim 25 including a plurality of connecting networks and a summing element and, wherein the bucket chain store is provided with a plurality of tappings each connected via a different one of said networks to said summating element.

28. apparatus according to claim 27 wherein the digital shift register is provided with a plurality of tappings, said apparatus further including a plurality of delta demodulators connecting said tappings to the summating element and an analog-to-digital converter coupled to the input of the first shift register.

29. Apparatus according to claim 18 in which the transmitting station and the receiver each include a separate command unit, a separate command detector, a separate control device adapted to influence the command unit and respond to the command detector and separate selector switches for each control device for changing the method of operation from reception to transmission or vice versa.

30. Apparatus according to claim 29 wherein the transmitting station and the receiver each include a supplementary code generator for generating a binary pulse sequence, a selector switch for operation by the control device to transmit either a command in the form of a binary pulse sequence generated by the command unit or a supplementary code in the form of a binary pulse sequence generated by said supplementary code generator.

31. Apparatus according to claim 30 including a band pass filter, a device alternately supplying two carrier frequencies that correspond to the binary pulse sequence to the modulating device, the said carrier frequencies being within the pass range of said band pass filter which is connected downstream of the modulating device and means adapted to respond to the control device for rendering the aforementioned modulating device unbalanced.

32. Apparatus according to claim 31 wherein the apparatus for supplying the carrier frequencies to the modulating device comprise a controllable frequency divider with a plurality of inputs for the parallel supply of input signals, said apparatus further including a first series-to-parallel converter for converting the binary pulse sequence from the code generator to a parallel signal and applying it to said plurality of inputs, a second series-to-parallel converter for changing the binary pulse sequence generated by the command unit or by the supplementary coding generator into a parallel control or command signal and applying it to said plurality of inputs.

* * * * *

UNITED STATES PATENT AND TRADEMARK OFFICE

CERTIFICATE OF CORRECTION

PATENT NO. : 4,068,094

DATED : Jan. 10, 1978

INVENTOR(S) : Schmid et al

It is certified that error appears in the above-identified patent and that said Letters Patent are hereby corrected as shown below:

Claim 2, line 2, change "the" to --time--.

Signed and Sealed this

*Thirteenth* Day of *June 1978*

[SEAL]

*Attest:*

RUTH C. MASON
*Attesting Officer*

DONALD W. BANNER
*Commissioner of Patents and Trademarks*